US005375616A

United States Patent [19]

Chen

[11] Patent Number: 5,375,616

[45] Date of Patent: Dec. 27, 1994

[54] WET TOILET PAPER AUTOMATIC SUPPLIER

[76] Inventor: Chi-Shan Chen, C/O Hung Hsing Patent Service Center P.O. Box 55-1670, Taipei, Taiwan, Prov. of China

[21] Appl. No.: 134,009

[22] Filed: Oct. 12, 1993

[51] Int. Cl.[5] ..... B08B 3/10

[52] U.S. Cl. ..... 134/105; 134/122 R; 134/199; 68/202

[58] Field of Search ..... 134/198, 105, 199, 122 R, 134/64 R; 68/200, 202; 118/40, 216, 217, 235

[56] References Cited

U.S. PATENT DOCUMENTS

| | | |
|---|---|---|
| 3,707,945 | 1/1973 | Boone . |
| 3,749,313 | 4/1974 | Cassar et al. . |
| 3,848,822 | 11/1974 | Boone . |
| 4,084,080 | 4/1978 | McMahan . |
| 4,620,502 | 11/1986 | Kimble . |
| 4,667,846 | 5/1987 | Marceau . |
| 4,798,312 | 1/1989 | Scheiber . |
| 4,947,026 | 8/1990 | Groom et al. . |
| 5,031,258 | 7/1991 | Shaw . |

FOREIGN PATENT DOCUMENTS 3409905 9/1985 Germany .

OTHER PUBLICATIONS

PCT/F186/00146 16 Jun. 1988.

*Primary Examiner*—Frankie L. Stinson

[57] ABSTRACT

A wet toilet paper automatic supplier includes a toilet paper strip windably or foldably stored in a housing, a roller assembly having a plurality of rollers for directing the toilet paper outwardly from inside the housing by a driving device, a lower wetting device delivering water upwardly for capillarily wetting the toilet paper strip from an underside of the toilet paper strip, an upper wetting device positioned above the lower wetting device for indirectly distributing water downwardly towards the toilet paper strip, a paper discharging device for taking up the wetted toilet paper strip for discharging the wetted paper strip outwardly, and a pair of cuttig knives disposed on an upper and a lower side of the wetted paper strip for cutting the wetted paper strip to a desired paper length or size for providing an instantly wetting toilet paper for hygienic use.

11 Claims, 6 Drawing Sheets

WET TOILET PAPER AUTOMATIC SUPPLIER

BACKGROUND OF THE INVENTION

A conventional wet tissue or paper strip may be folded or wound to be stored in a container or can, which can be pulled outwardly for its use. However, the paper is premoisturized and stored in the closed container, thereby being easily mildewed especially when stored for a long time and possibly influencing health and hygiene for the use of the moisturized paper. The container for storing the moisturized paper therein are made by mass production in a factory. After using up the paper, the empty container shall be disposed to cause wasting of material and to increase environmental protection problem.

The present inventor has found the drawbacks of the conventional wet paper container, and invented the present automatic supplier for supplying wet toilet paper.

SUMMARY OF THE INVENTION

The object of the present invention is to provide a wet toilet paper automatic supplier including a toilet paper strip windably or foldably stored in a housing, a roller assembly having a plurality of rollers for directing the toilet paper outwardly from inside the housing by a driving device, a lower wetting device delivering water upwardly for capillarily wetting the toilet paper strip from an underside of the toilet paper strip, an upper wetting device positioned above the lower wetting device for indirectly distributing water downwardly towards the toilet paper strip, a paper discharging device for taking up the wetted toilet paper strip for discharging the wetted paper strip outwardly, and a pair of cuttig knives disposed on an upper and a lower side of the wetted paper strip for cutting the wetted paper strip to a desired paper length or size for providing an instantly wetting toilet paper for hygienic use.

DETAILED DESCRIPTION

Figure 6:
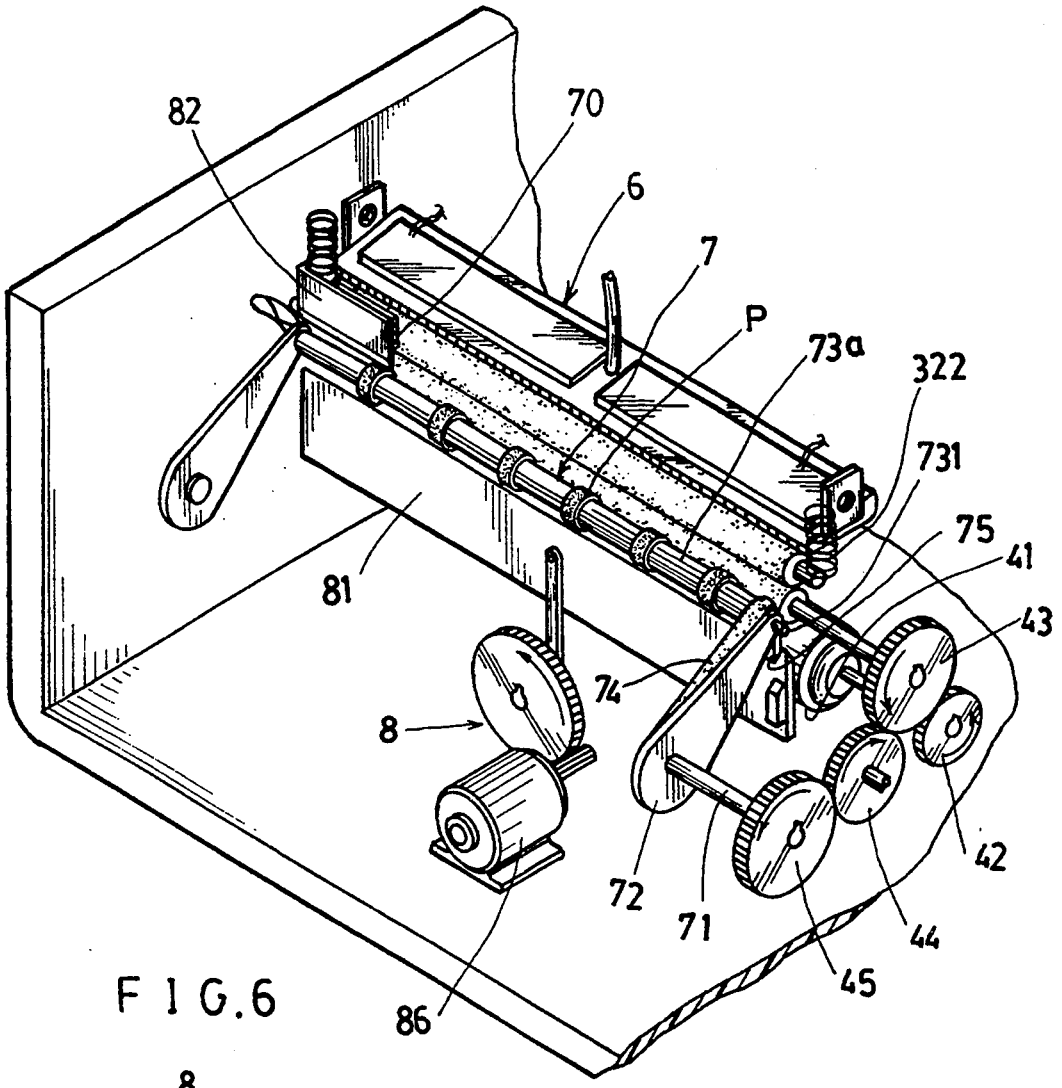
FIG. 6 shows another preferred embodiment of a paper discharging means of the present invention.

As shown in FIGS. 1–5, the present invention comprises: a housing 1, a toilet paper strip 2, a roller assembly 3, a driving means 4, a direct wetting means 5, an indirect wetting means 6, a paper discharging means 7, and a cutting means 8.

The toilet paper (or tissue) strip 2 may be wound on a reel 21 rotatably held in the housing 1 or may be foldably stored in the housing 1.

The roller assembly 3 includes: a driving roller 31 having a driving roller shaft 311 rotatably held in the housing 1 and provided with a driving roller gear 43 which is driven by a driving gear 42 secured to a motor shaft of a driving motor 41 of the driving means 4, a follower roller 32 rotatably engageable with the driving roller 31 for operatively clamping the toilet paper strip 2 between the driving roller 31 and the follower roller 32 rotatably mounted on a follower roller axle 321 which is held in the housing 1 and resiliently urged by a tensioning spring 322 to closely contact the follower roller 32 with the driving roller 31, and a pair of idler rollers 33 disposed on two opposite surfaces of the toilet paper strip 2 for guiding the paper strip 2 to the driving roller 31 and the follower roller 32.

The driving means 4 includes: the driving motor 41, the driving gear 42, the driving roller gear 43, and a paper discharging gear 45 which is driven by the driving roller gear 43 by an intermediate transmission gear 44 for driving the paper discharging means 7. The driving gear 42, the driving roller gear 43, the intermediate transmission gear 44, and the paper discharging gear 45 are defined as a transmission gear set 40 of the driving means 4.

Figure 1:
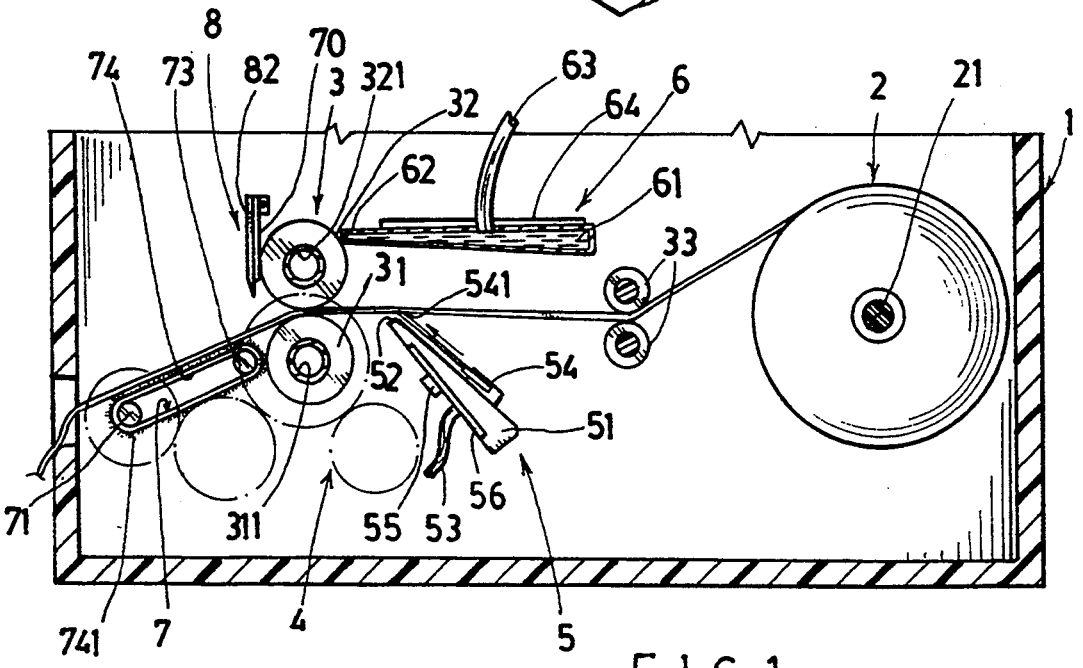
FIG. 1 is a illustration showing systematic elements of the present invention.

The direct wetting means 5 positioned under the indirect wetting means 6 includes: a first water distributing container 51 secured in the housing 1 under the toilet paper strip 2, a capillary wetting port 52 formed on an upper end of the first water distributing container 51 adjacent to the driving roller 31 and having a width generally equal to a width of the toilet paper strip 2 with the capillary wetting port 52 normally contacting a bottom surface of the toilet paper strip 2, a first water conduit 53 connected with the first water distributing container 51 for supplying water into the container 51 from a water source for capillarily wetting the toilet paper strip 2 in contact with the capillary wetting port 52, an electromagnetic latch 54 having a latch tip 541 operatively raising the toilet paper strip 2 to be separated from the wetting port 52 when wetting operation is not required as shown in FIG. 1, an overflow water collector 55 secured to the first water distributing container 51 for collecting water overflowing from the wetting port 52 for recirculation use, and a first water heater 56 for heating or warming water in the first water distributing container 51.

The indirect wetting means 6 includes: a second water distributing container 61 positioned above the toilet paper strip 2 filled with water in the container 61, a water draining port 62 formed on an opening end of the second water distributing container 61 slightly contacting a circumferential surface of the follower roller 32 for draining water on the follower roller 32 for transferring water into the upper surface of the toilet paper strip 2 for wetting the paper strip 2, a second water conduit 63 supplying water into the second water distributing container 61, and a second water heater 64 for heating the water in the second water distributing container 61.

Both wetting means 5, 6 can be served together for wetting the toilet paper strip 2 or either wetting means 5 or 6 can be individually provided for wetting the paper strip according to practical requirement.

Figure 7:
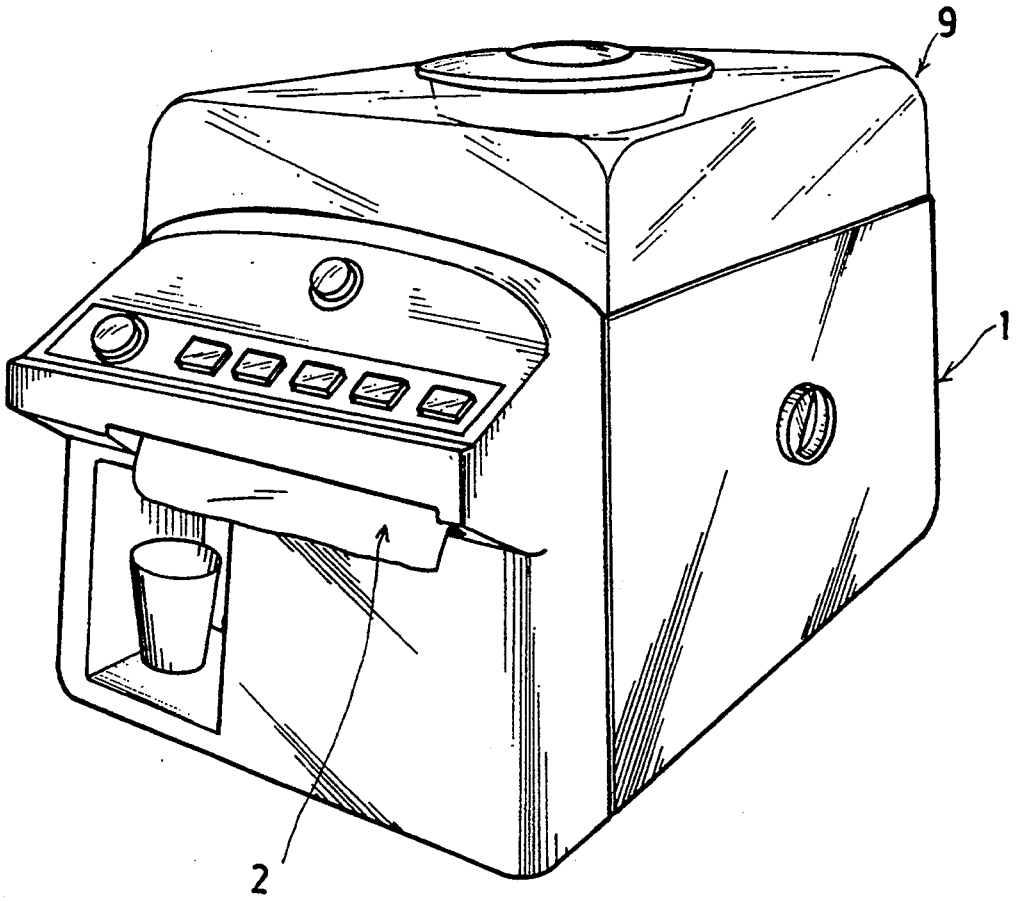
FIG. 7 is an illustration of the present invention combined with a drinking water reservoir.
Figure 8:
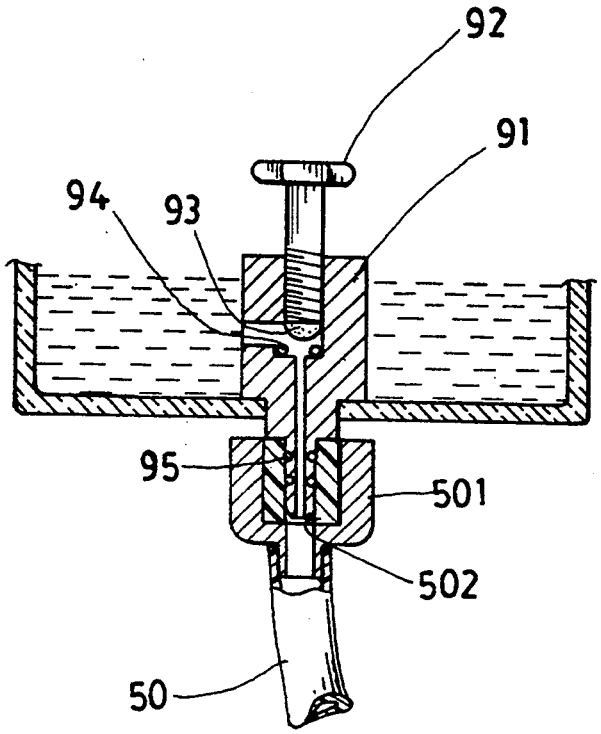
FIG. 8 is an illustration showing a conduit system from a water reservoir.

The water source may be obtained from a water reservoir 9 positioned on a top portion of the housing 1 as shown in FIGS. 7 and 8, wherein the reservoir 9 is provided with a valve 91 having a plug 93 secured on a bottom portion of a handle 92 for sealing a valve opening 94 in the valve 91 and a male adapter 95 for detachably connecting a coupling connector 501 of a main water conduit 50 having an adapter hole 502 engaged with the male adapter 95. The main conduit 50 may be bifurcated to supply water to the first and second conduits 53, 63.

Figure 2:
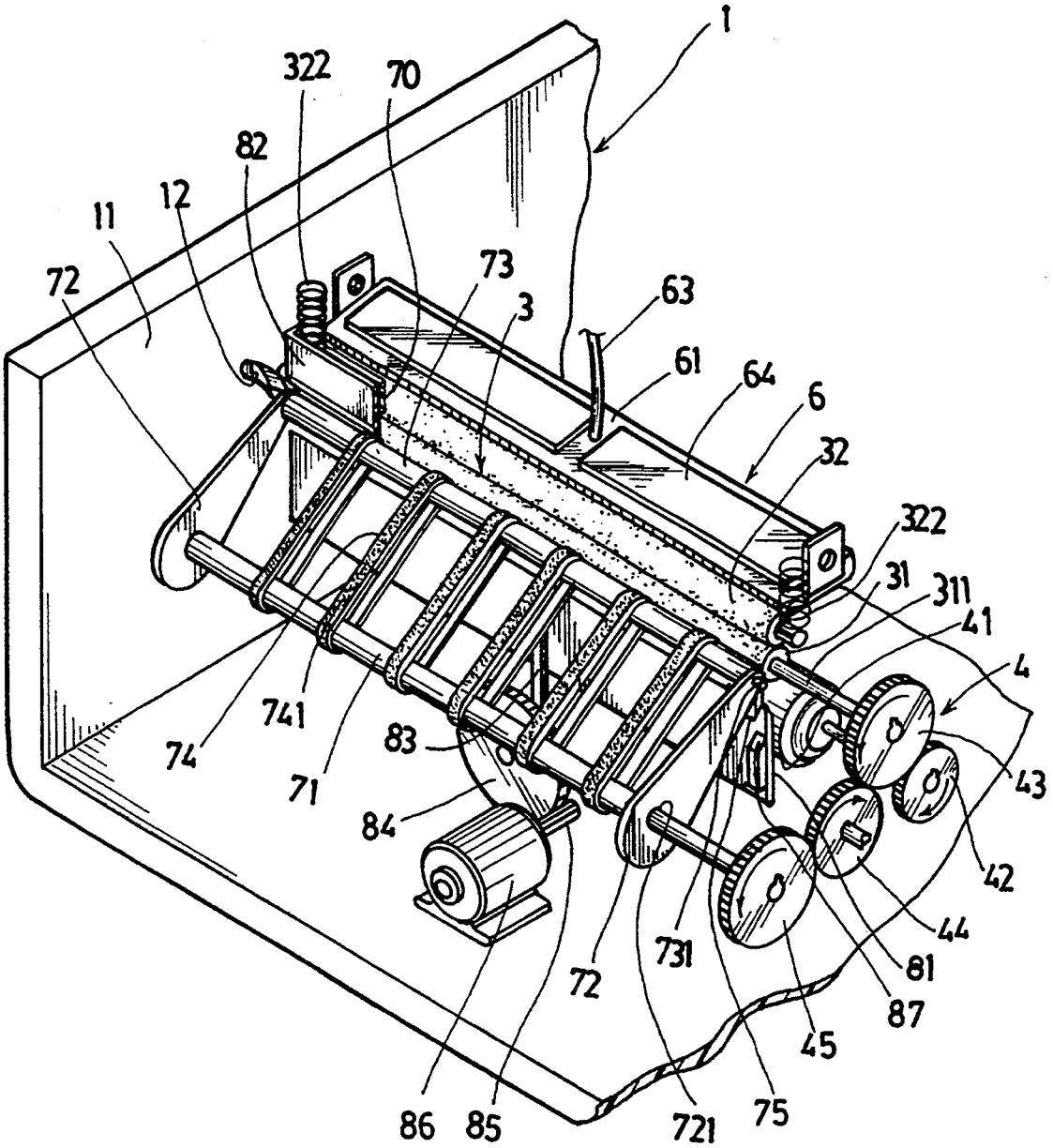
FIG. 2 is a perspective view of the present invention.
Figure 4:
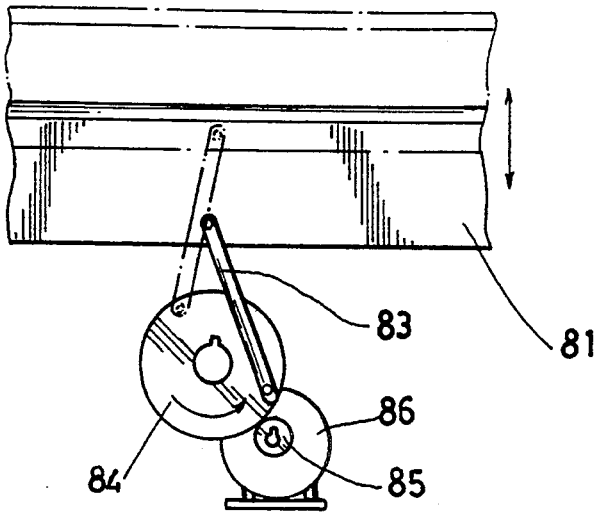
FIG. 4 shows an up-and-down movement of a lower cutting knife of the present invention.
Figure 3:
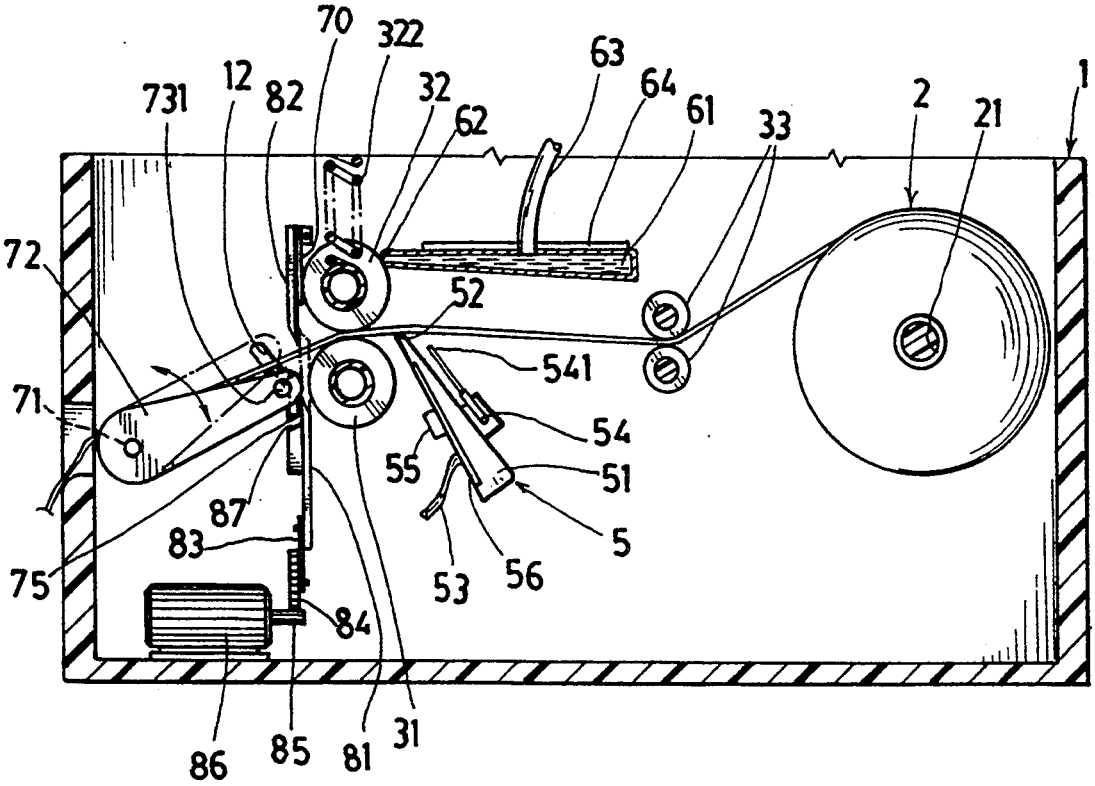
FIG. 3 is an illustration showing a cutting operation of the present invention.

The paper discharging means 7 includes: a driving shaft 71 rotatably mounted in the housing 1 and secured to a paper-discharging gear 45 to be rotatably driven by the driving motor 41 through the gears 42, 43, 44 and 45, a belt carrying frame 72 having a shaft hole 721 formed through a lower portion of the frame 72 for rotatably engaging the driving shaft 71 in the shaft hole 721, a follower sleeve 73 rotatably mounted on a sleeve spindle 731 which is secured to an upper portion of the belt carrying frame 72 and slidably held in an arcuate slot 12 formed in two opposite side walls 11 of the housing 1 as shown in FIG. 2, a plurality of take-up belts 74 each belt 74 having a plurality of fine bristles 741 formed on the belt 74 rotatably contacting a circumferential surface of the driving roller 31 for smoothly taking up a wetted toilet paper strip 2 passing through the driving roller 31 and the follower roller 32 as shown in FIG. 1 to prevent an adhering and winding of the wet paper strip 2 on the driving roller 31 with each take-up belt 74 formed as an endless belt wound about the driving shaft 71 and the follower sleeve 73 for forwarding a wetted toilet paper strip 1 from the driving and follower rollers 31, 32 outwardly as laid on the belts 74, and a follower wedge 75 having an inclined bottom surface sloping downwardly outwardly and secured to a front end portion of the frame 72 to be thrusted upwardly by a tripping wedge 87 formed on an upper portion of the cutting means 8 for separating the belts 74 from a cutting means 8 positioned on an outer side of the driving and follower rollers 31, 32 for preventing cutting injury by the cutting means 8.

The paper discharging means 7 may be modified as shown in FIG. 6, which includes a take-up roller **73*a* having a plurality of collars 74*a* juxtapositionally mounted on the take-up roller 73*a* each collar 74*a* having fine bristles 741 formed on a circumference of the collar 74*a* for taking up wetted toilet paper strip 2 from the roller assembly 2. The take-up roller 73*a* is driven by the driving means 4**.

The cutting means 8 positioned between the driving roller 31 and the paper discharging means 7 includes: a lower knife 81 slidably held in the housing, a crank arm 82 pivotally connecting the lower knife 81 and an eccentric gear 84 rotatably mounted in the housing 1, a knife-moving motor 86 having a pinion 85 rotatably engageable with the eccentric gear 84 for rotating the eccentric gear 84 for eccentrically moving the crank arm 83 for reciprocatively moving the lower knife 81 upwardly and downwardly, an upper knife 82 fixedly secured on the housing 1 above the lower knife 81 and cooperatively cutting a wetted toilet paper strip 2 delivered outwardly by the driving and follower rollers 31, 32 when the lower knife 81 is raised upwardly, and the follower wedge 75 having an inclined upper surface sloping downwardly outwardly and operatively engageable with the follower wedge 75 formed on the paper discharging means 7 for thrusting the follower wedge 75 and the paper discharging means 7 upwardly to separate from the cutting means 8 to prevent an injury such as cutting of a user's hand.

The paper discharging means 7 further includes a scraper 70 fixed on the housing 1 to tangentially contact a circumferential surface of the follower roller 32 for scraping off any wetted toilet paper strip 2 adhered and wound on the follower roller 32, ensuring a discharge of wetted paper strip by the paper discharging means 7.

Figure 5:
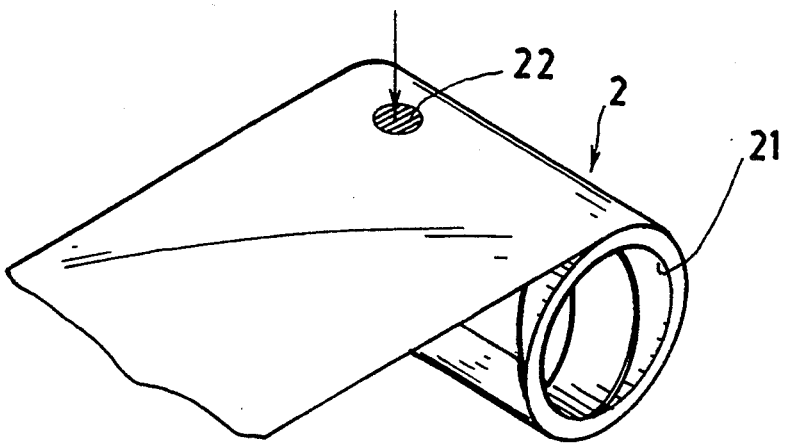
FIG. 5 shows a toilet paper strip of the present invention wound on a reel when approximately used up.

As shown in FIG. 5, the toilet paper strip 2 has its inner end portion formed with a deep color marking 22 to be sensed by a photoelectric sensor (not shown) which will operatively switch off a power source supplied to the driving means 4, the wetting means 5, 6, the roller assembly 3, the cutting means 8, etc. for safety purpose.

As shown in FIG. 7, the present invention may be combined with a drinking or hot water reservoir or supplier 9. The water source for wetting the paper strip 2 may be supplied from such a reservoir 9.

The present invention is superior to a conventional wet paper container because of an instantly wetting may prevent mildew problem for hygienic and health purpose. Also, the paper can be re-filled in the housing 1 and there is no problem for the disposal of paper container as found in a conventional wet paper container or can.

The present invention may be modified without departing from the spirit and scope as claimed in this invention.

Figure 6A:
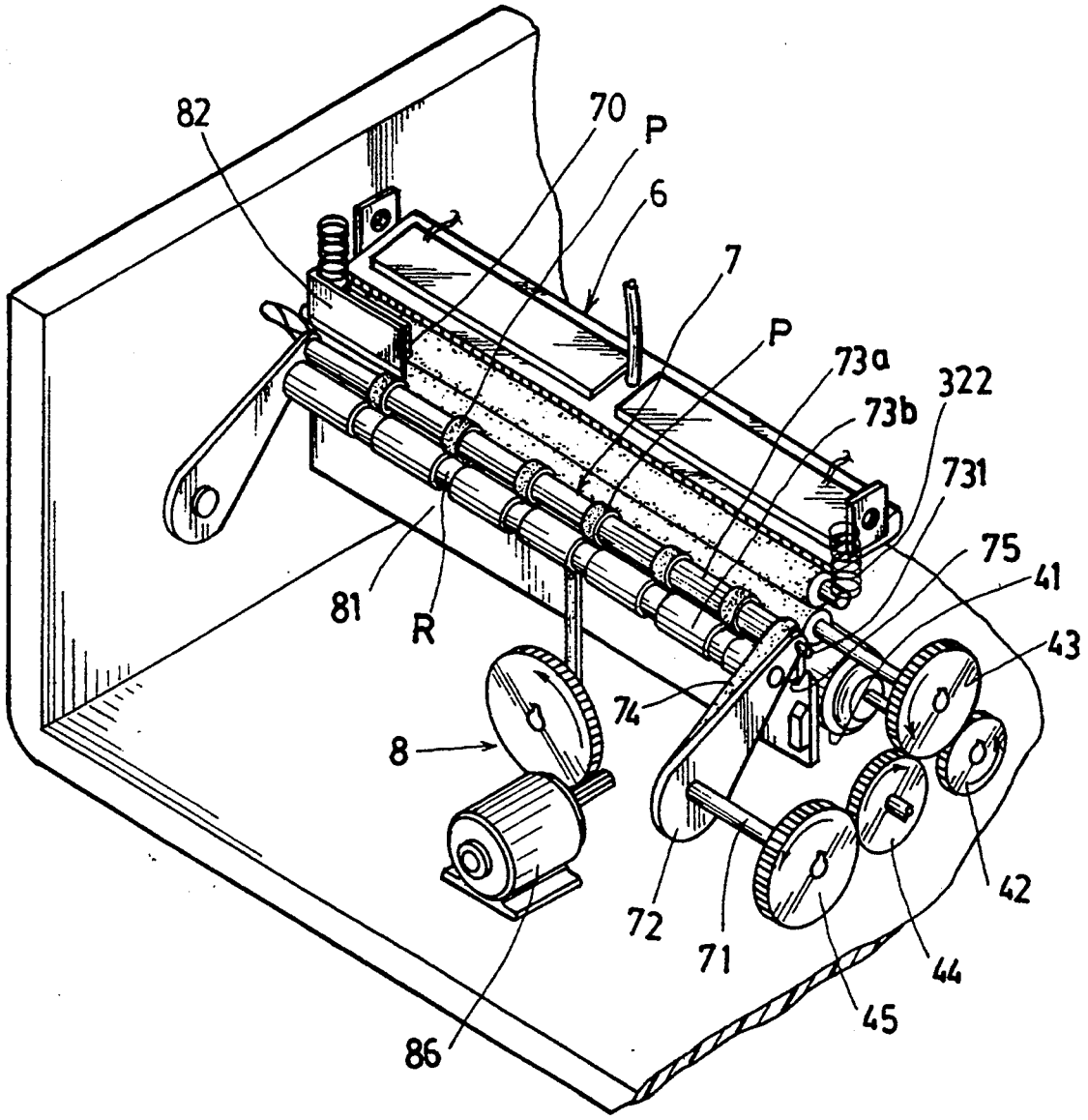
FIG. 6A is a modification of FIG. 6.

As shown in FIG. 6A, the paper discharging means 7 can be modified to be a plurality of discharging rollers **73*a*, 73*b* with the two neighbouring discharging rollers 73*a*, 73*b* provided with male protrusions P on a first discharging roller 73*a* and with female recesses R recessed in a second discharging roller 73*b*, each said protrusion P rotatably received in each said recess R so that the rollers 73*a*, 73*b* can be juxtapositioned and simultaneously driven by the belt 74 and gear 45 for taking up the wetted paper 2 from the driving and follower rollers 31, 32 as cut by the cutting means 8**.

I claim:

1. A wet toilet paper automatic supplier comprising: a toilet paper strip windably or foldably stored in a housing, a roller assembly having at least a driving roller and a follower roller rotatably engaging with each other for directing the toilet paper strip outwardly from inside the housing by a driving means having a driving motor provided in the housing, a direct wetting means delivering water upwardly for capillarily wetting the toilet paper strip from an underside of the toilet paper strip, an indirect wetting means positioned above the direct wetting means for distributing water downwardly towards the toilet paper strip through the follower roller, a paper discharging means for taking up wetted toilet paper strip for discharging the wetted paper strip outwardly, and a cuttig means operatively cutting the wetted paper strip to a desired paper length for providing an instantly wetting toilet paper for hygienic use.

2. A wet toilet paper automatic supplier according to claim 1, wherein said direct wetting means positioned under the indirect wetting means includes: a first water distributing container secured in the housing under the toilet paper strip, a capillary wetting port formed on an upper end of the first water distributing container adjacent to the driving roller and having a width generally equal to a width of the toilet paper strip with the capillary wetting port normally contacting a bottom surface of the toilet paper strip, a first water conduit connected with the first water distributing container for supplying water into the container from a water source for capillarily wetting the toilet paper strip in contact with the capillary wetting port, an electromagnetic latch having a latch tip operatively raising the toilet paper strip to be separated from the wetting port when wetting operation is not required, an overflow water collector secured to the first water distributing container for collecting water overflowing from the wetting port for recirculation use, and a first water heater for heating or warming water in the first water distributing container.

3. A wet toilet paper automatic supplier according to claim 2, wherein said indirect wetting means includes: a second water distributing container positioned above the toilet paper strip filled with water in the container, a water draining port formed on an opening end of the second water distributing container slightly contacting a circumferential surface of the follower roller for draining water on the follower roller for transferring water into the upper surface of the toilet paper strip for wetting the paper strip, a second water conduit supplying water into the second water distributing container, and a second water heater for heating the water in the second water distributing container.

4. A wet toilet paper automatic supplier according to claim 2, wherein said paper discharging means includes: a driving shaft rotatably mounted in the housing and secured to a paper-discharging gear to be rotatably driven by the driving motor through a gear set, a belt carrying frame having a shaft hole formed through a lower portion of the frame for rotatably engaging the driving shaft in the shaft hole, a follower sleeve rotatably mounted on a sleeve spindle which is secured to an upper portion of the belt carrying frame and slidably held in an arcuate slot formed in two opposite side walls of the housing, a plurality of take-up belts each belt having a plurality of fine bristles formed on the belt rotatably contacting a circumferential surface of the driving roller for smoothly taking up a wetted toilet paper strip passing through the driving roller and the follower roller to prevent an adhering and winding of the wet paper strip on the driving roller with each said take-up belt formed as an endless belt wound about the driving shaft and the follower sleeve for forwarding a wetted toilet paper strip from the driving and follower rollers outwardly as laid on the belts, and a follower wedge having an inclined bottom surface sloping downwardly outwardly and secured to a front end portion of the frame to be thrusted upwardly by a tripping wedge formed on an upper portion of the cutting means for separating the belts from a cutting means positioned on an outer side of the driving and follower rollers for preventing cutting injury by the cutting means.

5. A wet toilet paper automatic supplier according to claim 4, wherein said cutting means positioned between the driving roller and the paper discharging means includes: a lower knife slidably held in the housing, a crank arm pivotally connecting the lower knife and an eccentric gear rotatably mounted in the housing, a knife-moving motor having a pinion rotatably engageable with the eccentric gear for rotating the eccentric gear for eccentrically moving the crank arm for reciprocatively moving the lower knife upwardly and downwardly, an upper knife fixedly secured on the housing above the lower knife and cooperatively cutting a wetted toilet paper strip delivered outwardly by the driving and follower rollers when the lower knife is raised upwardly, and the tripping wedge having an inclined upper surface sloping downwardly outwardly and operatively engageable with the follower wedge formed on the paper discharging means for thrusting the tripping wedge and the paper discharging means upwardly to separate from the cutting means to prevent an injury.

6. A wet toilet paper automatic supplier according to claim 4, wherein said paper discharging means further includes a scraper fixed on the housing to tangentially contact a circumferential surface of the follower roller for scraping off a wetted toilet paper strip adhered and wound on the follower roller, ensuring a discharge of wetted paper strip by the paper discharging means.

7. A wet toilet paper automatic supplier according to claim 1, wherein the toilet paper strip has its inner end portion formed with a deep color marking to be sensed by a photoelectric sensor for operatively switching off a power source supplied to the driving means, the wetting means, the roller assembly, the cutting means and the paper discharging means for safety purpose.

8. A wet toilet paper automatic supplier according to claim 1, wherein said wet toilet paper automatic supplier is combined with a drinking water reservoir.

9. A wet toilet paper automatic supplier according to claim 8, wherein the reservoir is provided with a valve having a plug secured on a bottom portion of a handle for sealing a valve opening in the valve and a male adapter for detachably connecting a coupling connector of a main water conduit having an adapter hole engaged with the male adapter, said main conduit bifurcated to supply water to a first and a second conduits directed to a first and second water distributing containers.

10. A wet toilet paper automatic supplier according to claim 1, wherein said paper discharging means includes a take-up roller having a plurality of collars juxtapositionally mounted on the take-up roller each said collar having fine bristles formed on a circumference of the collar for taking up wetted toilet paper strip from the roller assembly, said take-up roller operatively driven by the driving means.

11. A wet toilet paper automatic supplier according to claim 1, wherein said paper discharging means includes: a plurality of discharging rollers with two neighbouring discharging rollers provided with male protrusions on a first discharging roller, and provided with female recesses recessed in a second discharging roller, each said protrusion rotatably received in each said recess so that the two discharging rollers can be juxtapositioned and simultaneously driven by a driving means for taking up a wetted paper from the driving and follower rollers as cut by the cutting means.

* * * * *